US011794228B2

(12) United States Patent
Owoeye et al.

(10) Patent No.: US 11,794,228 B2
(45) Date of Patent: Oct. 24, 2023

(54) HIGH PERFORMANCE ALLOY FOR CORROSION RESISTANCE

(71) Applicant: Saudi Arabian Oil Company, Dhahran (SA)

(72) Inventors: Oladele Owoeye, Dhahran (SA); Fauzia Rahman Eko Waluyo, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 54 days.

(21) Appl. No.: 17/205,688

(22) Filed: Mar. 18, 2021

(65) Prior Publication Data

US 2022/0297172 A1 Sep. 22, 2022

(51) Int. Cl.

| | |
|---|---|
| ***B21B 19/04*** | (2006.01) |
| ***C22C 38/48*** | (2006.01) |
| ***C22C 38/44*** | (2006.01) |
| ***C21C 5/00*** | (2006.01) |
| ***C22C 38/00*** | (2006.01) |
| ***C22C 38/02*** | (2006.01) |
| ***C21C 7/00*** | (2006.01) |
| ***C21C 5/52*** | (2006.01) |
| ***C21C 5/56*** | (2006.01) |

(52) U.S. Cl.

CPC ..... *B21B 19/04* (2013.01); *C21C 5/005* (2013.01); *C21C 5/5211* (2013.01); *C21C 5/562* (2013.01); *C21C 7/0006* (2013.01); *C21C 7/0025* (2013.01); *C22C 38/001* (2013.01); *C22C 38/002* (2013.01); *C22C 38/02* (2013.01); *C22C 38/44* (2013.01); *C22C 38/48* (2013.01)

(58) Field of Classification Search

CPC ..... C21C 5/005; C21C 5/5211; C21C 5/562; C21C 7/0006; C21C 7/0025; C22C 38/44; C22C 38/001; C22C 38/002; C22C 38/02; C22C 38/48; B21B 19/04

USPC ..... 75/353

See application file for complete search history.

(56) References Cited

U.S. PATENT DOCUMENTS

| | | | | |
|---|---|---|---|---|
| 6,093,235 | A * | 7/2000 | Reichel | C21C 5/30 75/375 |
| 7,874,352 | B2 | 1/2011 | Odell et al. | |
| 7,946,356 | B2 | 5/2011 | Koederitz et al. | |
| 9,404,322 | B2 | 8/2016 | Wiedecke et al. | |
| 2011/0226486 | A1 | 9/2011 | Haugen | |

(Continued)

FOREIGN PATENT DOCUMENTS

| | | |
|---|---|---|
| CN | 103789708 | 5/2014 |
| RU | 2603735 | 7/2015 |

(Continued)

OTHER PUBLICATIONS

VAC AERO International, Vacuum Degassing of Steel, Dec. 5, 2017 (Year: 2017).*

(Continued)

*Primary Examiner* — Brian D Walck
*Assistant Examiner* — Danielle Carda
(74) *Attorney, Agent, or Firm* — Fish & Richardson P.C.

(57) ABSTRACT

A corrosion resistant alloy, a method for making the corrosion resistant alloy, and a method for using the corrosion resistant alloy are provided. The corrosion resistant alloy includes 13-15 wt. % chromium, 5-7 wt. % nickel, and 2.5-4.5 wt. % molybdenum.

12 Claims, 5 Drawing Sheets

(56) References Cited

U.S. PATENT DOCUMENTS

| | | | | |
|---|---|---|---|---|
| 2014/0116686 | A1 | 5/2014 | Odell et al. | |
| 2020/0283866 | A1* | 9/2020 | Endo | C21D 6/008 |

FOREIGN PATENT DOCUMENTS

| | | |
|---|---|---|
| WO | WO 2012161661 | 11/2012 |
| WO | WO 2013142950 | 10/2013 |

OTHER PUBLICATIONS

Bowman, Savita, Steel 101, ClearPath, Mar. 17, 2021 (Year: 2021).*
Thomson Gale, How Products are Made-Steel Pipe, vol. 5, 2006 (Year: 2006).*
Amaya et al., "Effect of Chromium and Molybdenum on Corrosion Resistance of Super 13CR Martensitic Stainless Steel in CO2 Environment," NACE International, Corrosion, Mar. 22-27, 1998, 98:113, 16 pages.
jfe-steel.co.jp [online], "WetCo2 Service," 203-2021, retrieved on Apr. 2, 2021, retrieved from URL <https://www.jfe-steel.co.jp/en/products/energy/octg/material/13c_hp.html>, 4 pages.
neonalloys.com [online], "Alloy Super 131CR/UNS S41427," 2016, retrieved on Apr. 2, 2021, retrieved from URL <https://www.neonalloys.com/alloy-super-13cr-uns-s41427.php>, 2 pages.

* cited by examiner

100

200

300

400

500

HIGH PERFORMANCE ALLOY FOR CORROSION RESISTANCE

TECHNICAL FIELD

The present disclosure is directed to a corrosion resistant stainless steel alloy that includes chromium and molybdenum.

BACKGROUND

As produced, crude oil and natural gas often include acidic gases, such as carbon dioxide and hydrogen sulfide. Further, produced water that often accompanies the production of these hydrocarbons may include high concentrations of salts, such as chlorides, among others. Along with the high temperatures present in wells, these materials create conditions that can cause corrosion in tubulars, such as production tubing.

Corrosion resistant tubulars are used extensively within Saudi Aramco operations in corrosive environments that include carbon dioxide, hydrogen sulfide, and high chloride content at elevated temperatures. The corrosion resistant tubulars are often made from a type of high chromium stainless steel called super 13Cr. However, in some environmental conditions, the super 13Cr itself is vulnerable to corrosion. In these environments, alloys that are more expensive, such as duplex steel or nickel-based alloys, are used to reduce the risk of pitting corrosion and mitigate the risk of stress corrosion cracking at elevated temperature ranges.

SUMMARY

An exemplary embodiment described herein provides a corrosion resistant alloy. The corrosion resistant alloy includes 13-15 wt. % chromium, 5-7 wt. % nickel, and 2.5-4.5 wt. % molybdenum.

Another exemplary embodiment provides a method for making a corrosion resistant alloy. The method includes forming a molten steel, refining the molten steel to remove nitrogen gas, refining the molten steel to remove hydrogen gas, obtaining a sample of the molten steel, and determining a composition of the sample. The method includes adjusting the composition of the molten steel to include 13-15 wt. % chromium, 5-7 wt. % nickel, and 2.5-4.5 wt. % molybdenum.

Another exemplary embodiment described herein provides a method for making a seamless tubular from a corrosion resistant alloy. The method includes forming a molten steel, refining the molten steel to remove nitrogen gas, refining the molten steel to remove hydrogen gas, obtaining a sample of the molten steel, and determining a composition of the sample. The method includes adjusting the composition of the molten steel to include 13-15 wt. % chromium, 5-7 wt. % nickel, and 2.5-4.5 wt. % molybdenum. The method also includes casting the corrosion resistant alloy to form billets and hot rolling and piercing the billets to form the seamless tubular.

DETAILED DESCRIPTION

Figure 1:
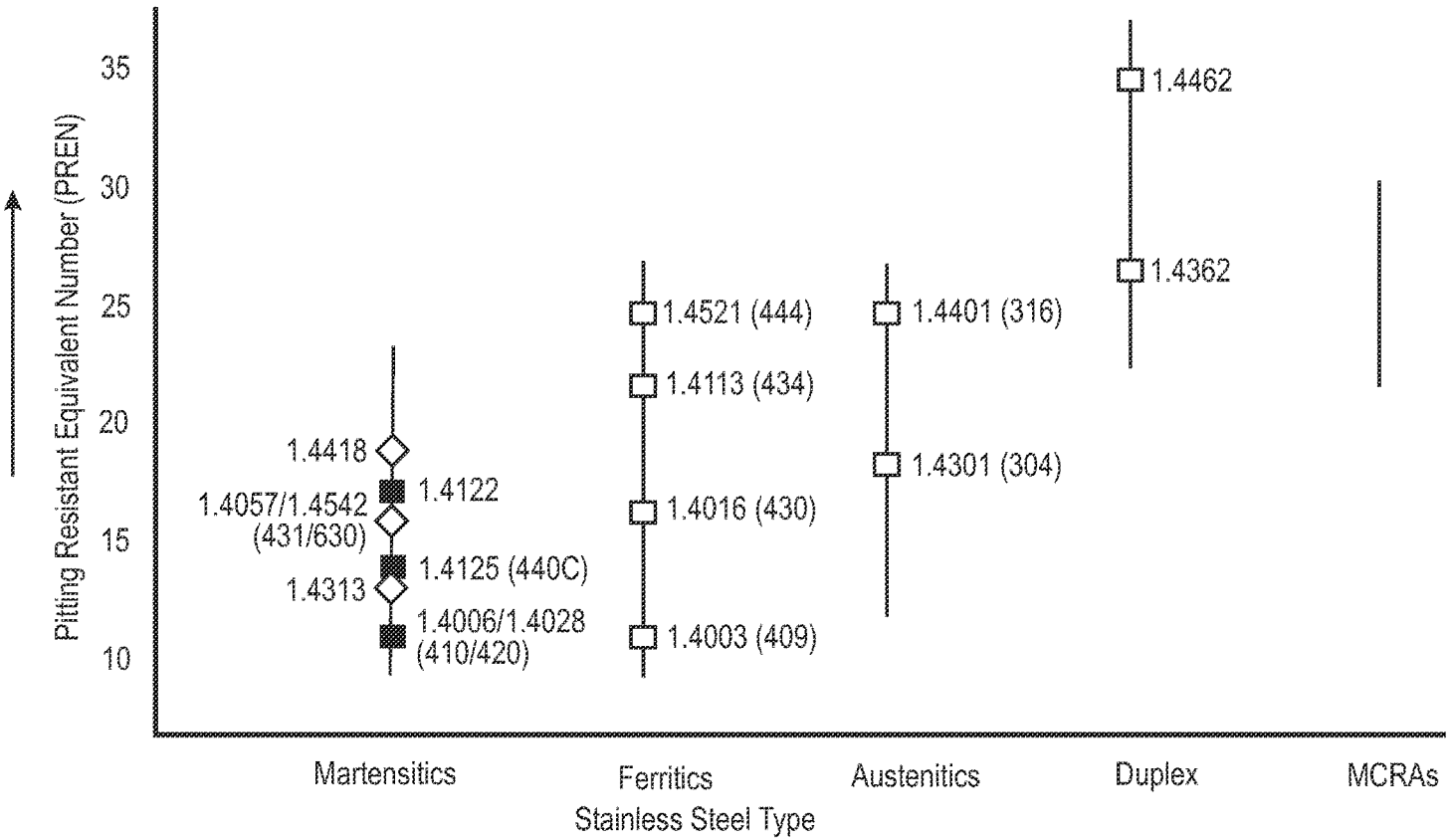
FIG. 1 is a comparison of the PREN for a number of different stainless steel types, including martensitic, ferritic, austenitic, and duplex with the MCRAs described herein.

Tubulars made from a 13 Cr or Super 13 Cr with a martensitic microstructure have temperature limitations of around 100° C. and 175° C. respectively in sweet corrosion environments with high chloride content (25 wt. % NaCl) before the onset of pitting corrosion and stress corrosion cracking (SCC). The corrosion resistance of stainless steel is primarily determined by chemical composition, rather than microstructure, as composition promotes the formation of passive films on the surface that protect from corrosion. Chromium is often used as the main ingredient in corrosion resistant alloys in martensitic stainless steel.

As used herein, the microstructure of stainless steel is described by four terms, martensitic, ferritic, austenitic, and duplex, depending on the primary crystal structure present. Martensitic steel has a body-centered tetragonal structure and can be hardened and tempered through working and heat treatment. The microstructure is influenced by composition, and, thus, the microstructure often correlates with corrosion resistance.

As used herein, 13Cr is a steel alloy that has a composition that includes around 13% Cr, in addition to amounts of other elements, such as about 0.2 wt. % C, about 0.15 wt. % Ni, and about 0 wt. % Mo. Similarly, super 13Cr has a composition that includes about 13% Cr, but changes the proportions of other elements to increase the strength and corrosion resistance, such as about 0.03 wt. % C, about 2-5 wt. % Ni, and up to 2 wt. % Mo.

The limitations of 13Cr and super 13Cr grades may result in more frequent workover operations to replace corroded tubulars. In severe cases, well integrity may be lost, resulting in sustained casing pressure in the tubing/casing annulus (TCA) or casing/casing annulus (CCA). Tubulars made from higher Cr content at about 22 wt. % or higher or nickel based alloys may be used to mitigate the corrosion, but at substantially higher cost (i.e. over 600% cost increase if a nickel based alloy is used).

Modified corrosion resistant alloys (MCRAs) are provided herein for improving resistance to corrosion, such as pitting and stress cracking. The MCRAs have a modified composition that enhances corrosion performance without significantly increasing cost. The MCRAs provide a lower cost solution to address pitting corrosion and reduce SCC, for example, in sweet acidic environments at higher temperatures. As used herein, a sweet environment has low concentrations of sulfur compounds, such as less than about 0.5 vol. %, while a sour environment has higher concentrations of $H_2S$. However, other acid gases may still be present, such as carbon dioxide at concentrations of greater than about 1 vol. %. The MCRAs provided may act as a transition to higher cost duplex steel or nickel alloy products for corrosion resistant tubulars in these environments. The composition of the MCRAs is:

0.01-0.02 wt. % C;

13-15 wt. % Cr;

5-7 wt. % Ni;
2.5-4.5 wt. % Mo;
0.05-0.1 wt. % Nb;
0.01 wt. % N;
0.005 wt. % S;
0.015 wt. % P; and
0.5 wt. % Si.

The nitrogen is held to a low amount, for example, below 0.2 wt. %, or below 0.1 wt. %, or lower, to be able to use an argon oxygen decarburization process, which is more economical than other processes. A higher wt. % of nitrogen, such as 0.4 wt. % would necessitate the use of a more expensive process, such as pressure electroslag refining (PESR).

FIG. 1 is a comparison 100 of the PREN for a number of different stainless steel types, including martensitic, ferritic, austenitic, and duplex with the MCRAs described herein. As described in API Spec SCRA of April 2015, the PREN may be calculated from the composition of the alloys by the equation below:

$$PREN=(1\times wt.\ \%\ Cr)+(3.3\times wt.\ \%\ Mo)+(16\times wt.\ \%\ N)$$

The PREN ranges overlap as the composition of the alloy provides the most important control over the corrosion. Although the microstructure can influence the corrosion resistance, it is more important to other properties, including hardness, strength, ductility, ability to be tempered, or ability to be welded, among others.

The MCRAs described herein have a PREN in the range of 21.4-30. The amount of the chromium available to form a passive oxide film is increased by increasing the weight percent of molybdenum in the alloy mixture rather than deliberately increasing chromium content. This provides corrosion performance similar to higher cost duplex alloys, and thus providing a transition to duplex stainless Steel. Increasing the weight percent of the molybdenum in the MCRAs decreases the amount of chromium precipitating as chromium rich carbides while increasing the amount of molybdenum carbides. This increase there is sufficient chromium to form passive chromium oxide film.

Increasing the molybdenum also decreases the tendency of previously formed passive films to break down by decreasing the number of point defects in the passive film. Further, the increased molybdenum content reduces the critical dissolution rate of the MCRAs, both in acidified chloride solutions and in strong acids. This reduces the impact of acid treatment on a tubular formed from the MCRAs. Thus, the higher molybdenum content may increase the protectiveness of the passive film and limit the interaction of the base steel material with the corrosive fluid, reducing the risk of pitting corrosion and stress corrosion cracking.

Increasing the weight percent of molybdenum in the MCRAs below its solubility limit can be achieved using a solid-solution hardening heat treatment, which involves heating the alloy mixture to a sufficiently high temperature to dissolve the molybdenum-rich precipitates and then cooling rapidly to avoid re-precipitation. This ensures higher concentration of molybdenum is dissolved beyond its equilibrium concentration. With the increase in the weight percent of molybdenum, martensitic stainless steel can be formed with similar pitting corrosion resistance properties as duplex steel and provide a transition to higher cost duplex steel. The PREN may be used as a guide to adjust the weight percent of molybdenum in the MCRAs. The manufacturing process and heat treatment would then be used to deliver the final product formed from the corrosion resistance stainless steel.

Increasing the weight percent of the molybdenum in the MCRAs using solid solution hardening has the additional benefit of increasing the temperature elevation strength of the resultant alloy. Relative to iron, molybdenum is a large atom, which will impede the movement of dislocations within the lattice structure. Accordingly, this would require higher stress level or temperature to enable a dislocation in the lattice to continue to propagate. This increases the strength of the MCRAs beyond the current temperature range of 13 Cr or Super 13 Cr stainless steel.

Figure 2:
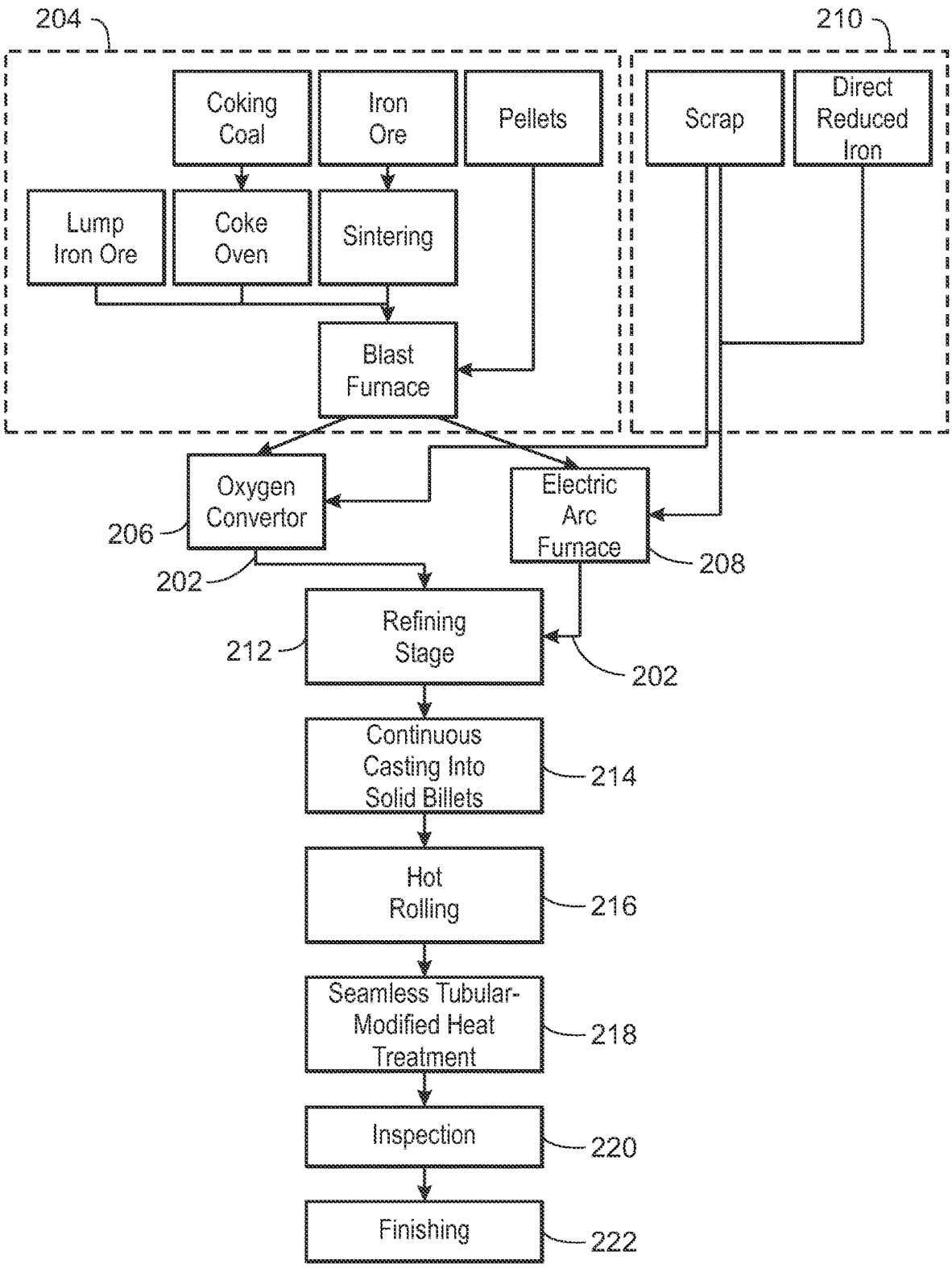
FIG. 2 is a process flow diagram of a method 200 for forming a seamless tubular using the MCRAs described herein.

FIG. 2 is a process flow diagram of a method 200 for forming a seamless tubular using the MCRAs described herein. The molten steel 202 used for the production of the MCRAs may be provided by conventional steel making processes. For example, a blast furnace process 204 may produce an initial melt that is processed further in an oxygen convertor 206 or an electric arc furnace process 208 to produce the molten steel 202. In addition to any initial melt provided by the blast furnace process 204, the electric arc furnace process 208 or the oxygen convertor 206 may be provided a feed that includes recycled metals and other components 210.

The modification of the composition of the stainless steel product to form the MCRAs is performed in a refining stage 212 where samples of the molten steel are taken from the ladle. The composition is determined and alloying materials, including the molybdenum, among others, are determined and added.

In addition to adjusting the metal composition, the refining stage 212 is used to remove $N_2$ and $H_2$ gas dissolved in the molten steel and adjust the carbon content of the MCRAs. For example, the carbon content may be increased by the addition of coke or decreased by flowing oxygen through the molten metal. This allows modification of the heat treatment properties by changing the carbon dissolution in the stainless steel matrix, for example, to increase the carbon content to allow increase hardening without resulting in residual grain boundary carbide.

After the refining stage 212 is completed forming a MCRA of a particular composition, the MCRA is cast 214 into billets. In some embodiments, the billets are round solid cylinders of the MCRA that are used to form further parts. At block 216, the billets are hot rolled to form seamless tubing. For example, the billets are cut into segments and heated, for example, in a rotary furnace, to prepare for further processing. The hot segments are fed between rollers that hold the pipe as a hydraulic ram forces a reamer through the center to form the tube. During further processing, the seamless tubing is elongated to a final length in the rollers, which may be used to harden the MCRA.

At block 218, further heat treatment after the tubing is performed. This may be used for tempering, hardening, or relieving stresses in the tubing. Once the tubing is inspected at block 220, at block 222, the tubing is finished, for example, by forming threaded connections at each end.

Figure 3:
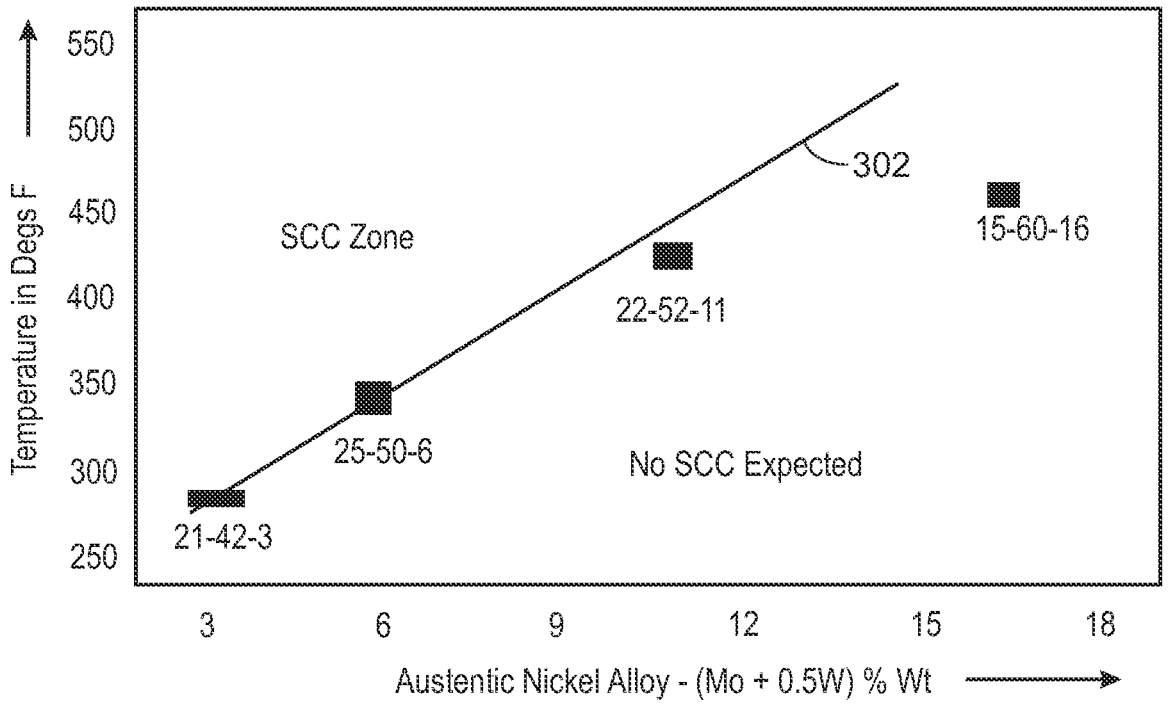
FIG. 3 is a plot of the SCC temperature competence of an austenitic nickel based alloy.

FIG. 3 is a plot 300 of the SCC temperature competence of an austenitic nickel based alloy. This highlights the improvement in temperature strength of a nickel-based alloy as a function of increase in the weight percent of molybdenum. Above the line 302, the nickel-based alloy is at risk of pitting corrosion and SCC as the stability of the passive film is compromised, thus highlighting temperature limit of the alloy at different weight percentages of molybdenum. For example, 21-42-3 alloy in FIG. 3 represents a nickel alloy with 21 wt. % Cr, 31 wt. % Ni, and 3 wt. % Mo while 15-60-16 alloy reflects a nickel alloy with 15 wt. % Cr, 60 wt. % Ni, and 16 wt. % Mo. This can be compared to the SCC temperature competence of the MCRA showing improving temperature competence with increasing Mo content.

Figure 4:
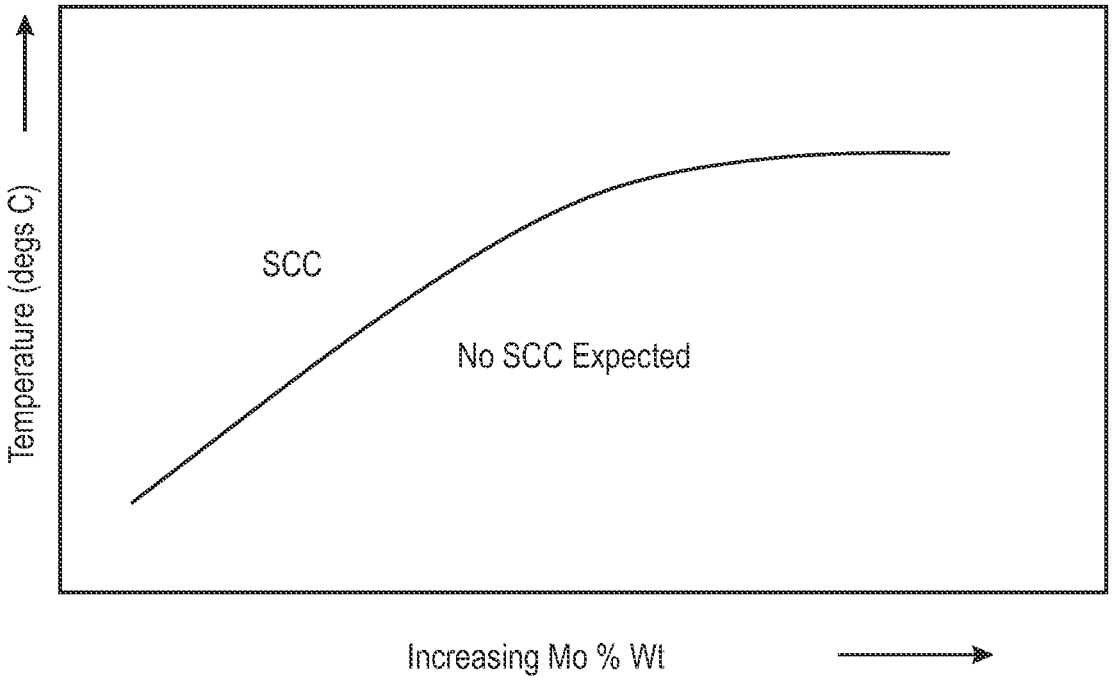
FIG. 4 is a plot of the anticipated pitting corrosion and SCC temperature competence of the MCRAs.

FIG. 4 is a plot 400 of the anticipated pitting corrosion and SCC temperature competence of the MCRAs. The plot 400 highlights the anticipated improvement in pitting corrosion and SCC temperature competence from increasing the weight percent of molybdenum in the MCRAs. The SCC temperature competence is expected to plateau as the molybdenum reaches its solubility limit. At the solubility limit, the molybdenum starts to form intermetallic phases in thick sections within the MCRAs thereby affecting the ductility or corrosion characteristics. The solubility limit is one factor used to determine the upper concentration of the molybdenum that can be used. As described with respect to FIG. 5, cost is another limitation.

Figure 5:
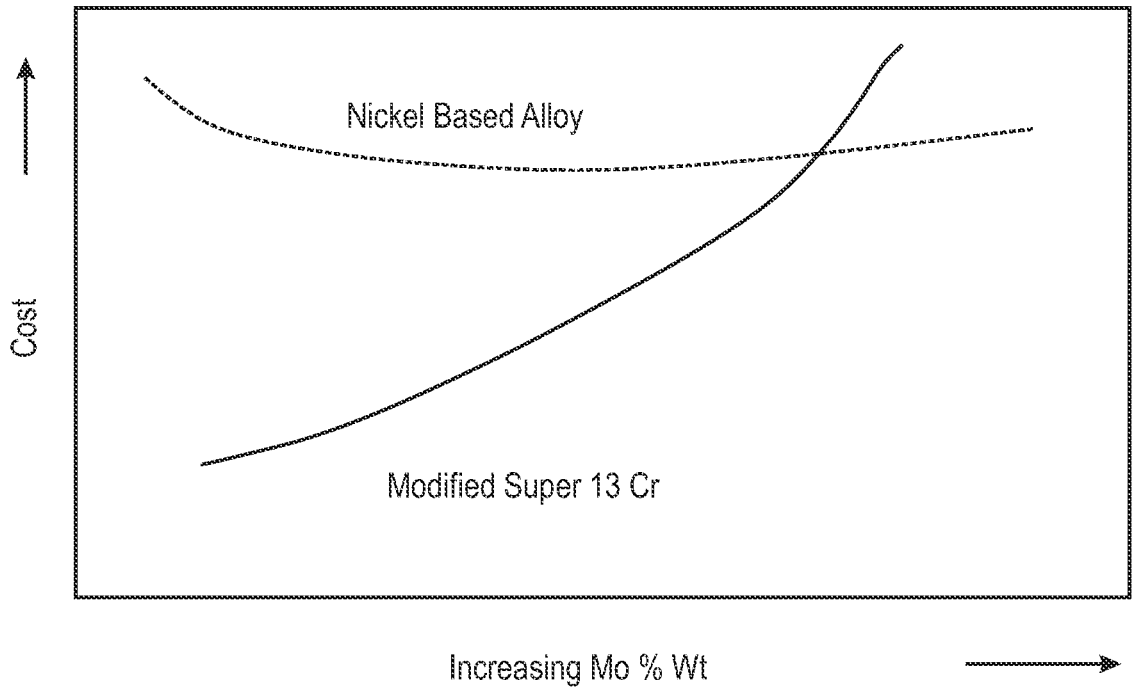
FIG. 5 is a plot comparing the costs ratio of desired CRA alloy to 13 Cr tubular using 7" 32 lbs/ft 95 Ksi tubular as the basis of comparison to that of Nickel based alloy.

FIG. 5 is a plot 500 comparing the costs of nickel-based alloys, such as 25-50-6 tubular with the MCRAs as the molybdenum content is increased. Thus, 13 Cr tubular will have a cost ratio of 1 while nickel-based alloy 25-50-6 tubular will have a cost ratio of around 6.6. The expectation is that the cost ratio for the MCRAs as the molybdenum content is increased will follow the relationship: 1<MCRA cost ratio <<<6.6 and if we compare it to duplex steel the cost ratio will follow the same trend: 1<MCRA cost ratio<<duplex cost ratio.

The cost has been based on using 7" 32 Ibs/ft 95 Ksi tubular. The MCRAs are targeted to be much lower in cost than the nickel alloys for the given temperature limits. As the concentration of molybdenum in the MCRAs is increased, at some point the cost of the product will approach or exceed the costs of the nickel-base alloys. As increasing the Mo concentration in the Nickel alloy would mean the Mo will be substituting Ni in the alloy.

As described herein, the MCRAs are expected to be more resistant to pitting and SCC in high chloride environments at elevated temperatures than 13Cr and super 13Cr grades. Further, the MCRAs are expected to provide comparable corrosion resistant to super 17Cr. This will provide a lower cost transition to duplex stainless steel.

The MCRAs are expected to increase the operating temperature envelope over super 13Cr, for example, up to 200° C. This would cover the majority of tubulars in sweet corrosion environments at a lower cost solution than the duplex and nickel alloy products.

Accordingly, the MCRAs will reduce the costs of tubulars in sweet corrosion environments. In addition, the MCRAs will improve the temperature range and performance of to address pitting corrosion and stress corrosion cracking at these elevated temperature ranges.

As a result, the MCRAs will improve well integrity and reduce the risk of TCA and CCA associated with pitting corrosion in operations. This will reduce the frequency of workovers to change out tubulars, thereby reducing operating cost. When workovers are performed for other purposes, the MCRAs will allow reuse of the tubulars after inspection without incurring additional cost of tubing change out.

EXEMPLARY EMBODIMENTS

An exemplary embodiment described herein provides a corrosion resistant alloy. The corrosion resistant alloy includes 13-15 wt. % chromium, 5-7 wt. % nickel, and 2.5-4.5 wt. % molybdenum.

In an aspect, the corrosion resistant alloy includes 0.01-0.02 wt. % carbon. In an aspect, the corrosion resistant alloy includes 0.05-0.1 wt. % niobium. In an aspect, the corrosion resistant alloy includes less than 0.01 wt. % nitrogen. In an aspect, the corrosion resistant alloy includes less than 0.005 wt. % sulfur. In an aspect, the corrosion resistant alloy includes less than 0.015 wt. % phosphorus. In an aspect, the corrosion resistant alloy includes less than 0.5 wt. % silicon.

In an aspect, the corrosion resistant alloy includes a pitting resistance equivalent number (PREN) of 21.4-30.

Another exemplary embodiment provides a method for making a corrosion resistant alloy. The method includes forming a molten steel, refining the molten steel to remove nitrogen gas, refining the molten steel to remove hydrogen gas, obtaining a sample of the molten steel, and determining a composition of the sample. The method includes adjusting the composition of the molten steel to include 13-15 wt. % chromium, 5-7 wt. % nickel, and 2.5-4.5 wt. % molybdenum.

In an aspect, the method includes forming the molten steel from iron ore in a blast furnace. In an aspect, the method includes forming the molten steel from scrap metal in an electric arc furnace.

In an aspect, the method includes adjusting the carbon content of the molten steel to be 0.01-0.02 wt. % by flowing oxygen through the molten steel to lower the carbon content, or adding coke to the molten steel to increase the carbon content.

In an aspect, the method includes adding niobium to the molten steel to adjust a niobium content to 0.05-0.1 wt. %. In an aspect, the method includes adjusting the composition to increase a pitting resistance equivalent number (PREN) according to the formula:

$$PREN=(1\times wt.\ \%\ Cr)+(3.3\times wt.\ \%\ Mo)+(16\times wt.\ \%\ N).$$

In an aspect, the method includes adjusting the composition to control the PREN at 21.4 to 30.

Another exemplary embodiment described herein provides a method for making a seamless tubular from a corrosion resistant alloy. The method includes forming a molten steel, refining the molten steel to remove nitrogen gas, refining the molten steel to remove hydrogen gas, obtaining a sample of the molten steel, and determining a composition of the sample. The method includes adjusting the composition of the molten steel to include 13-15 wt. % chromium, 5-7 wt. % nickel, and 2.5-4.5 wt. % molybdenum. The method also includes casting the corrosion resistant alloy to form billets and hot rolling and piercing the billets to form the seamless tubular.

In an aspect, the method includes forming thread at each end of the seamless tubular. In an aspect, the method includes drawing the seamless tubular to a small diameter.

In an aspect, the method includes adjusting the carbon content of the composition to change the hardness of the seamless tubular. In an aspect, the method includes adjusting the carbon content to be 0.01-0.02 wt. % to control the hardness of the tubular by flowing oxygen through the molten steel to lower the carbon content, or adding coke to the molten steel to increase the carbon content.

Other implementations are also within the scope of the following claims.

What is claimed is:

1. A method for making a corrosion resistant alloy, comprising:

forming a molten steel;

refining the molten steel to remove nitrogen gas;

refining the molten steel to remove hydrogen gas;
obtaining a sample of the molten steel;
determining a composition of the sample; and
adjusting the composition of the molten steel to consist essentially of:
0.01-0.02 wt % carbon;
0.05-0.1 wt. % niobium;
13-15 wt. % chromium;
5-7 wt. % nickel;
2.5-4.5 wt. % molybdenum; and
an amount of iron to bring the composition to 100 wt. %.

2. The method of claim 1, comprising forming the molten steel from iron ore in a blast furnace.

3. The method of claim 1, comprising forming the molten steel from scrap metal in an electric arc furnace.

4. The method of claim 1, comprising, after determining the composition of the sample, adjusting the carbon content of the molten steel by:
flowing oxygen through the molten steel to lower the carbon content; or
adding coke to the molten steel to increase the carbon content.

5. The method of claim 1, comprising adding niobium to the molten steel to adjust a niobium content to 0.05-0.1 wt. %.

6. The method of claim 1, comprising adjusting the composition to increase a pitting resistance equivalent number (PREN) according to the formula:

$$PREN=(1\times wt.\ \%\ Cr)+(3.3\times wt.\ \%\ Mo)+(16\times wt.\ \%\ N).$$

7. The method of claim 6, comprising adjusting the composition to control the PREN at 21.4 to 30.

8. A method for making a seamless tubular from a corrosion resistant alloy, comprising:
forming a molten steel;
refining the molten steel to remove nitrogen gas;
refining the molten steel to remove hydrogen gas;
obtaining a sample of the molten steel;
determining a composition of the sample; and
adjusting the composition of the molten steel to consist essentially of:
0.01-0.02 wt % carbon;
0.05-0.1 wt. % niobium;
13-15 wt. % chromium;
5-7 wt. % nickel;
2.5-4.5 wt. % molybdenum; and
an amount of iron to bring the composition to 100 wt. %; and
casting the corrosion resistant alloy to form billets; and
hot rolling and piercing the billets to form the seamless tubular.

9. The method of claim 8, comprising forming thread at each end of the seamless tubular.

10. The method of claim 8, comprising drawing the seamless tubular to a small diameter.

11. The method of claim 8, comprising, after determining the composition of the sample, adjusting the carbon content of the composition to change the hardness of the seamless tubular.

12. The method claim 11, comprising adjusting the carbon content to be 0.01-0.02 wt. % to control the hardness of the tubular by:
flowing oxygen through the molten steel to lower the carbon content; or
adding coke to the molten steel to increase the carbon content.

* * * * *